US005943744A

United States Patent [19]

Norte

[11] Patent Number: 5,943,744

[45] Date of Patent: Aug. 31, 1999

[54] MULTI-FUNCTIONAL CLIP FOR VERTICALLY STACKED MULTI-LAYER MAGNETIC TRANSFORMERS

[75] Inventor: David A. Norte, Westminster, Colo.

[73] Assignee: Lucent Technologies Inc., Murray Hill, N.J.

[21] Appl. No.: 09/158,014

[22] Filed: Sep. 21, 1998

[51] Int. Cl.[6] ..... A44B 21/00

[52] U.S. Cl. ..... 24/458; 24/293; 24/563

[58] Field of Search ..... 24/458, 459, 457, 24/289, 293, 573.1, 545, 563, 3.11, 3.12

[56] References Cited

U.S. PATENT DOCUMENTS

| | | | |
|---|---|---|---|
| 2,654,131 | 10/1953 | Poupitch | 24/458 |
| 3,392,668 | 7/1968 | Young | 24/563 |
| 3,864,789 | 2/1975 | Leitner | 24/293 |
| 4,679,754 | 7/1987 | Richards | 24/458 |
| 5,189,766 | 3/1993 | Weber | 24/459 |
| 5,668,348 | 9/1997 | Lin | 24/458 |

*Primary Examiner*—Victor N. Sakran

[57] ABSTRACT

The multi-functional clip provides two functions: holding a plurality of multi-layer magnetic transformers together in a vertical stack; holding together the respective E-Cores of each of the plurality of multi-layer magnetic transformers. This is accomplished by the use the multi-functional clip that comprises a body, having four tapered flanges that extend vertically from the periphery of the body to form the arms that enclose and contact the multi-layer magnetic transformers. The vertically oriented arms each include a feature formed at a distal end thereof that mates with a recess formed in a side of a corresponding one of the multi-layer magnetic transformers. The vertically oriented arms are manufactured of a spring material to thereby apply a horizontal force to the multi-layer magnetic transformer. The four arms of the multi-functional clip maintain the plurality of the multi-layer magnetic transformers in the proper horizontal and vertical relationship while providing a horizontally directed force against the sides of the E-cores to hold the E-cores together.

9 Claims, 1 Drawing Sheet

MULTI-FUNCTIONAL CLIP FOR VERTICALLY STACKED MULTI-LAYER MAGNETIC TRANSFORMERS

FIELD OF THE INVENTION

This invention relates to multi-layer magnetic transformers and, in particular, to an apparatus for enabling the vertical stacking of a plurality of multi-layer magnetic transformers on a printed circuit board.

Problem

It is a problem in the field of multi-layer magnetic transformers to mount these devices in an efficient manner on a printed circuit board. The use of real state on a printed circuit board is costly and the reduction in the need to use the printed circuit board surface area represents a significant cost savings in the manufacture of printed circuit boards. This problem is especially pertinent in the use of multi-layer magnetic transformers, which occupy a significant amount of space on the printed circuit board. The vertically stacking of two of the multi-layer magnetic transformers is desirable, since it reduces in half the amount of space required on the printed circuit board. The vertical stacking of multi-layer magnetic transformers has in the past been effected by mechanically joining two multi-layer magnetic transformers in a vertical stack using solder paste or high temperature conductive epoxy adhesive. These solutions are of limited efficacy due to the likelihood of failures of the mechanical interconnection of the multi-layer magnetic transformers in the field. There is therefore a need for an effective manner of vertically stacking a plurality of multi-layer magnetic transformers on a printed circuit board.

Solution

The above described problems are solved and a technical advance achieved in the field by the present multi-functional clip for vertically stacked multi-layer magnetic transformers. The multi-functional clip provides two functions: holding a plurality of multi-layer magnetic transformers together in a vertical stack; holding together the respective E-Cores of each of the plurality of multi-layer magnetic transformers. This is accomplished by the use the multi-functional clip that comprises a body, having four tapered flanges that extend vertically from the periphery of the body to form the arms that enclose and contact the multi-layer magnetic transformers. The vertically oriented arms each include a feature formed at a distal end thereof that mates with a recess formed in a side of a corresponding one of the multi-layer magnetic transformers. The vertically oriented arms are manufactured of a spring material to thereby apply a horizontal force to the multi-layer magnetic transformer. The four arms of the multi-functional clip maintain the plurality of the multi-layer magnetic transformers in the proper horizontal and vertical relationship while providing a horizontally directed force against the sides of the E-cores to hold the E-cores together.

DETAILED DESCRIPTION

Figure 1:
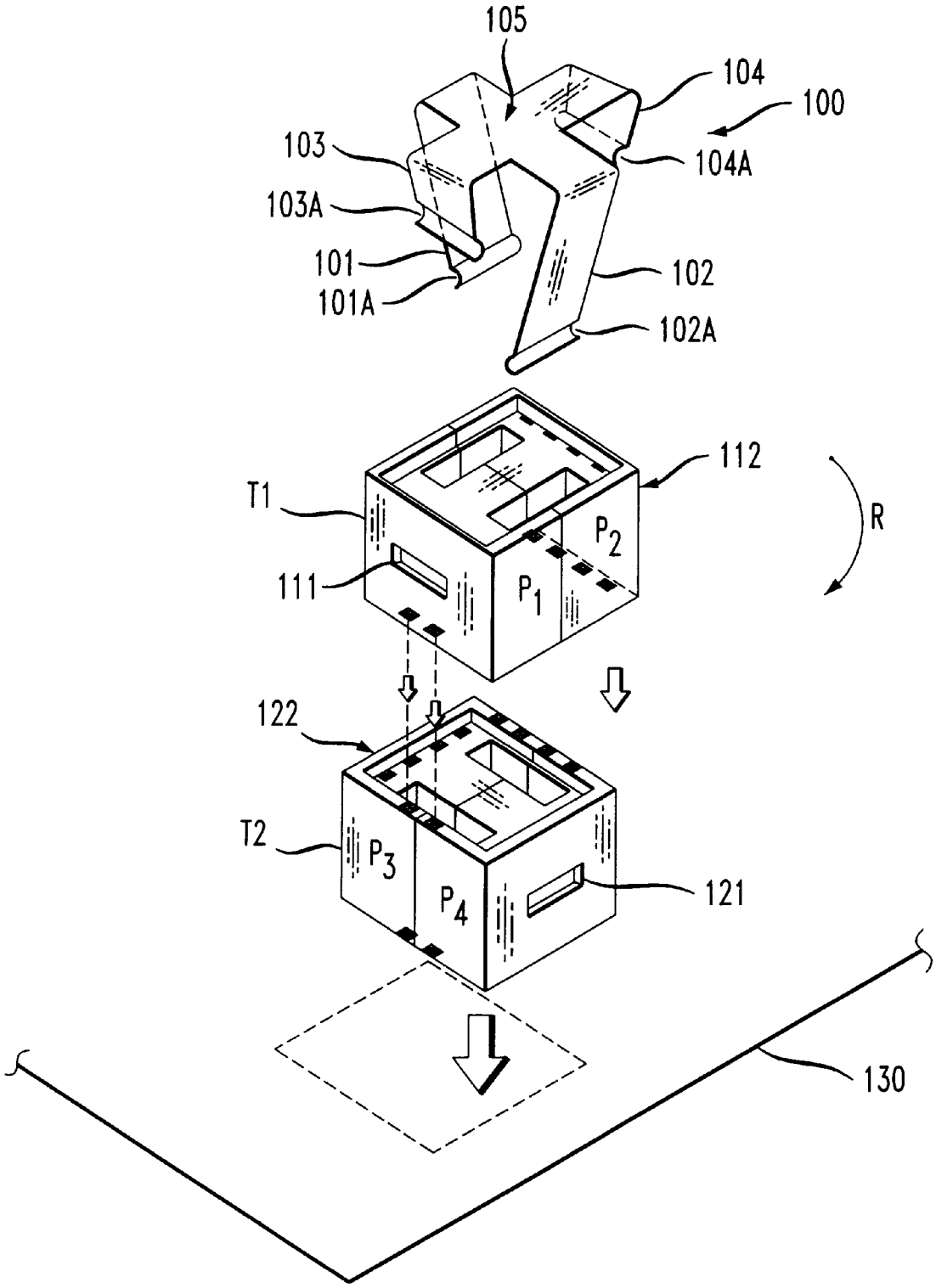
FIG. 1 illustrates a perspective view of the present multi-functional clip for vertically stacked multi-layer magnetic transformers, as used to interconnect two vertically stacked multi-layer magnetic transformers on a printed circuit board.

FIG. 1 illustrates a perspective view of the present multi-functional clip 100 for vertically stacked multi-layer magnetic transformers, as used to interconnect two vertically stacked multi-layer magnetic transformers T1, T2 on a printed circuit board 130. Each of the multi-layer magnetic transformers T1, T2 comprise a pair of E-cores P1, P2 and P3, P4, respectively. Each pair of E-cores (P1, P2 and P3, P4) must be securely held together in the orientation shown in FIG. 1, where each leg of an E-core must be aligned and juxtaposed to a corresponding leg of the other E-core of the pair. In addition, the two multi-layer magnetic transformers T1, T2 must be stacked vertically such that the two multi-layer magnetic transformers T1, T2 are securely held together and are oriented such that their respective sides are aligned. In order to accomplish this, the two multi-layer magnetic transformers T1, T2 are rotated, in the direction denoted by arrow R, 90° with respect to each other. Each of the multi-layer magnetic transformers T1, T2 include apertures 111, 112 and 121, 122 formed in the exterior vertical surface of opposing sides.

The multi-functional clip 100 comprises a body section 105, from which extend four arms 101–104 in a downward vertical direction (as shown in FIG. 1). The body 105 is shown as being formed in the shape of a cross, but can be in other shapes, such as a square. The cross configuration is selected to assist in the use of conventional pick and place techniques of automated surface mount manufacturing. Each of the four arms 101–104 extend downward from a corresponding side or leg of the base 105. Each of the four arms 101–104 are formed to be slightly inclined in an inward direction from the vertical toward a corresponding one of the four arms 101–104, located on an opposite side of the base 105, such that the arms are paired 101, 102 and 103, 104, with each pair of arms being of length corresponding to the distance from the base to the associated apertures 121, 122 and 111, 112, respectively, of the one of the multi-layer transformers T2, T1, respectively, that the pair of arms contacts. The four arms 101–104 contain a feature 101A–104A formed on the end thereof, distal from base 105, of dimensions to fit into the corresponding aperture 111, 112, 121, 122 formed on the multi-layer transformers T1, T2. In addition, the four arms 101–104 can be bend slightly upward from body 105 to allow for a compression force that securely holds the two transformers T1, T2 together in the vertical dimension as shown in FIG. 1 when the features 101A–104A are seated into features 111, 112, 121, 122. This bend also assists by increasing the horizontal forces applied to each E-core P1–P4 of the two transformers T1, T2.

The multi-layer transformers T1, T2 are placed one on top of the other and the multi-functional clip 100 is placed to enclose the two vertically stacked multi-layer transformers T1, T2 within the four arms 101–104. The pairs of arms 101, 102 and 103, 104 are forced in an outward direction by this process to align with and exert an inwardly directed force on the corresponding side of the multi-layer transformers T1, T2, due to the spring action of the four arms 101–104. The shape of the apertures 111, 112, 121, 122 and the corresponding features 101A–104A are selected to prevent movement of the arms 101–104 with respect to the multi-layer transformers T1, T2 when the features 101A–104A are seated in the associated apertures 111, 112, 121, 122. The inwardly directed force exerted by the four arms 101–104 on the multi-layer transformers T1, T2 and the secure mechanical connection of the features 101A–104A with the corresponding apertures 111, 112, 121, 122 thereby both holding a plurality of the two multi-layer magnetic transformers together in a vertical stack and holding together the respective E-Cores of each of the two multi-layer magnetic transformers.

What is claimed:

1. A multi-functional clip for securing first and second multi-layer transformers in a vertical stack, comprising:

a body;

four arms, each extending in a downward direction from a corresponding side of said body, first and second of said four arms being of a first length to contact said first multi-layer transformer, third and fourth of said four arms being of a second length to contact said second multi-layer transformer, said first and second arms being located on opposite sides of said body, said third and fourth arms being located on opposite sides of said body, to thereby secure said first and second multi-layer transformers, respectively, between said first and second, said third and fourth arms; and a feature formed on each of said four arms at an end distal from said body to mate with a corresponding aperture formed on a contacted side of a corresponding one of said first and second multi-layer transformers to prevent movement between said four arms and said first and second multi-layer transformers.

2. The multi-functional clip of claim 1 wherein said four arms are formed of a spring material and include a bend located adjacent said body and in a direction away from said first and second multi-layer transformers to thereby generate a downwardly directed force when said feature formed on each of said four arms at an end distal from said body to mate with a corresponding aperture formed on a contacted side of a corresponding one of said first and second multi-layer transformers.

3. The multi-functional clip of claim 1 wherein said four arms are formed of a spring material and oriented in an inward direction from the vertical to thereby generate an inwardly directed force when spread apart to a vertical position to contact said first and second multi-layer transformers.

4. A multi-functional clip for securing first and second multi-layer transformers in a vertical stack, comprising:

a body;

four arms, each extending in a downward direction from a corresponding side of said body, first and second of said four arms being of a first length to contact said first multi-layer transformer, third and fourth of said four arms being of a second length to contact said second multi-layer transformer, said first and second arms being located on opposite sides of said body, said third and fourth arms being located on opposite sides of said body, to thereby secure said first and second multi-layer transformers, respectively, between said first and second, said third and fourth arms;

a feature formed on each of said four arms at an end distal from said body to mate with a corresponding aperture formed on a contacted side of a corresponding one of said first and second multi-layer transformers to prevent movement between said four arms and said first and second multi-layer transformers;

wherein said four arms are formed of a spring material and oriented in an inward direction from the vertical to thereby generate an inwardly directed force when spread apart to a vertical position to contact said first and second multi-layer transformers.

5. The multi-functional clip of claim 4 wherein said four arms are formed of a spring material and include a bend located adjacent said body and in a direction away from said first and second multi-layer transformers to thereby generate a downwardly directed force when said feature formed on each of said four arms at an end distal from said body to mate with a corresponding aperture formed on a contacted side of a corresponding one of said first and second multi-layer transformers.

6. A multi-functional clip for securing first and second multi-layer transformers in a vertical stack, said first and second multi-layer transformers each comprising first and second segments, comprising:

a body;

four arms, each extending in a downward direction from a corresponding side of said body, first and second of said four arms being of a first length to contact said first multi-layer transformer and hold said first and second segments of said first multi-layer transformer together in a predetermined relationship, third and fourth of said four arms being of a second length, greater in length than said first length, to contact said second multi-layer transformer which is located below said first multi-layer transformer in a vertical stack, to hold said first and second segments of said second multi-layer transformer together in a predetermined relationship, said first and second arms being located on opposite sides of said body, said third and fourth arms being located on opposite sides of said body, to thereby secure said first and second multi-layer transformers, respectively, between said first and second, said third and fourth arms and to concurrently hold said second multi-layer transformer and said first multi-layer transformer in a vertical stack.

7. The multi-functional clip of claim 6 further comprising:

a feature formed on each of said four arms at an end distal from said body to mate with a corresponding aperture formed on a contacted side of a corresponding one of said first and second multi-layer transformers to prevent movement between said four arms and said first and second multi-layer transformers.

8. The multi-functional clip of claim 7 wherein said four arms are formed of a spring material and include a bend located adjacent said body and in a direction away from said first and second multi-layer transformers to thereby generate a downwardly directed force when said feature formed on each of said four arms at an end distal from said body to mate with a corresponding aperture formed on a contacted side of a corresponding one of said first and second multi-layer transformers.

9. The multi-functional clip of claim 6 wherein said four arms are formed of a spring material and oriented in an inward direction from the vertical to thereby generate an inwardly directed force when spread apart to a vertical position to contact said first and second multi-layer transformers.

* * * * *